US007434333B2

(12) United States Patent
Yang et al.

(10) Patent No.: US 7,434,333 B2
(45) Date of Patent: Oct. 14, 2008

(54) WASHING MACHINE

(75) Inventors: Byoung-yull Yang, Ansan-si (KR); Hyung-kyoon Kim, Suwon-si (KR); Sang-yeon Pyo, Suwon-si (KR); Jae-ryong Park, Suwon-si (KR); Hwang-mook Cho, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 88 days.

(21) Appl. No.: 11/184,954

(22) Filed: Jul. 20, 2005

(65) Prior Publication Data

US 2006/0016093 A1 Jan. 26, 2006

(30) Foreign Application Priority Data

Jul. 20, 2004 (KR) ..... 10-2004-0056275
Jul. 20, 2004 (KR) ..... 10-2004-0056276

(51) Int. Cl.
*F26B 11/02* (2006.01)

(52) U.S. Cl. ..... 34/603; 68/20; 8/149.1

(58) Field of Classification Search ..... 34/595, 34/601, 602, 603, 604, 605, 606; 8/149.1; 68/19.2, 20

See application file for complete search history.

(56) References Cited

U.S. PATENT DOCUMENTS

| | | | | |
|---|---|---|---|---|
| 2,694,867 | A * | 11/1954 | Smith | 34/605 |
| 2,742,708 | A * | 4/1956 | McCormick | 34/76 |
| 4,270,281 | A | 6/1981 | Muller | |
| 6,585,781 | B1 | 7/2003 | Roseen | |

FOREIGN PATENT DOCUMENTS

| | | | |
|---|---|---|---|
| EP | 1029961 | A2 | 8/2000 |
| JP | 49-19453 | | 2/1974 |
| JP | 55-110200 | | 1/1980 |
| JP | 56-58993 | U | 5/1981 |
| JP | 56-14594 | | 7/1981 |
| JP | 56-128199 | U | 9/1981 |
| JP | 58-195595 | A | 11/1983 |
| JP | 63-288193 | A | 11/1988 |
| JP | 08-047599 | A | 2/1996 |
| JP | 2000-304446 | A | 11/2000 |
| KR | 1988-0001764 | Y1 | 5/1988 |
| KR | 20-0135904 | Y1 | 11/1998 |
| KR | 20-0148962 | Y1 | 3/1999 |
| KR | 10-0179124 | B1 | 5/1999 |
| KR | 10-0379437 | B1 | 3/2003 |
| KR | 20-0309318 | Y1 | 3/2003 |
| KR | 2003-0040116 | A | 5/2003 |

* cited by examiner

*Primary Examiner*—S. Gravini
(74) *Attorney, Agent, or Firm*—Sughrue Mion, PLLC

(57) ABSTRACT

A washing machine includes a drum; a discharging duct communicating with the drum, and discharging inner air of the drum; a supplying duct communicating with the drum, and supplying external air into the drum to make a flow direction of the external air pass across that of the inner air; and a heat exchanger connected to the discharging and supplying ducts, in which a first air flow path which passes therethrough the inner air discharged outward through the discharging duct and a second air flow path which passes therethrough the external air supplied into the drum through the supplying duct cross each other. The washing machine may also include a humidity regulating part which reduces the humidity of the inner air as it is discharged. Thus, the washing machine improves efficiency of heat exchange between the inner air and the external air through the heat exchanger.

19 Claims, 8 Drawing Sheets

WASHING MACHINE

CROSS-REFERENCE TO RELATED APPLICATIONS

This application claims the benefit of Korean Patent Application Nos. 2004-0056275 and 2004-0056276, both filed Jul. 20, 2004, in the Korean Intellectual Property Office, the disclosures of which are incorporated herein by reference.

BACKGROUND OF THE INVENTION

1. Field of the Invention

The present invention relates to a washing machine and, more particularly, to a washing machine exchanging heat between inner air discharged from a drum and external air supplied into the drum through a heat exchanger to enhance drying efficiency.

2. Description of the Related Art

Generally, a drum type washing machine is an appliance intended to carry out a washing operation by falling clothes during rotation through 360 degrees of a rotatable washing chamber, and it also carries out rinsing, dewatering and drying operations.

A drying operation of the washing machine is classified into a circulation drying operation circulating inner air discharged from a drum, and a non-circulation drying operation supplying external air into the drum to dry the clothes.

As shown in FIG. 1, a conventional washing machine of the non-circulation drying operation comprises a drum 1; a supplying duct 2 supplying external air into the drum 1; a circulating fan 3 provided at a portion of the supplying duct 2 and introducing the external air into the drum 1; a heater 4 heating the external air introduced into the supplying duct 2; a discharging duct 5 discharging inner air used in a drying operation outward; and a heat exchanger 6 exchanging heat between the external air passing through the supplying duct 2 and the inner air passing through the discharging duct 5.

The conventional washing machine may make the temperature of the external air supplied into the drum 1 increase so that power consumption of the heater 4 is decreased, and also make the temperature of the inner air discharged therefrom decrease. The conventional washing machine with this configuration is disclosed in Korean Patent Application No. 10-2000-0059274.

However, in the conventional washing machine the supplying duct 2 and the discharging duct 5 are disposed side by side so that a flow direction of the inner air is opposite to that of the external air.

Accordingly, it is difficult to enhance heat-exchange efficiency between the external air and the inner air through the heat exchanger 6.

Further, temperature and humidity of the internal air discharged outward are often higher than that of the external air in a building. Accordingly, though the temperature and the humidity of the internal air are decreased a little while the internal air passes through the heat exchanger, the temperature and the humidity of the internal air are, in some instances, still too high to discharge the air in a building.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

Accordingly, an aspect of the present invention provides a washing machine to improve efficiency of heat exchange between inner air and external air through a heat exchanger.

Additional aspects and/or advantages of the invention will be set forth in part in the description which follows and, in part, will be apparent from the description, or may be learned by practice of the invention.

The foregoing and/or other aspects of the present invention are achieved by providing a washing machine comprising: a drum; a discharging duct which communicates with the drum, and which discharges inner air of the drum outward; a supplying duct which communicates with the drum, and which supplies external air into the drum to make a flow direction of the external air pass across that of the inner air discharged outward through the discharging duct; and a heat exchanger connected to the discharging duct and the supplying duct, in which a first air flow path which passes therethrough the inner air discharged outward through the discharging duct and a second air flow path which passes therethrough the external air supplied into the drum through the supplying duct cross each other.

According to an aspect of the invention, the first air flow path and the second air flow path are respectively provided plurally, and are alternately stacked up on each other.

According to an aspect of the invention, members which form the first air flow paths and the second air flow paths are respectively shaped like waves.

According to an aspect of the invention, the members which form the first air flow paths and the second air flow paths comprise aluminum.

According to an aspect of the invention, the washing machine further comprises an inner circulation duct communicating with the discharging duct and the supplying duct and to facilitate the flow of the inner air.

In another embodiment of the invention, the washing machine further comprises a humidity modulating part which communicates with the first flow path of the heat exchanger and which decreases humidity of the inner air which passes through the first flow path.

According to an aspect of the invention, the humidity modulating part comprises porous material.

According to an aspect of the invention, the humidity modulating part comprises a casing which communicates with the heat exchanger and has an opening at a side thereof, and a filler filled inside the casing so as to pass therethrough the inner air.

According to an aspect of the invention, the washing machine further comprises a temperature modulating fan flowing outer air from a rear of the heat exchanger, and which decreases the temperature of the inner air discharged outward through the heat exchanger.

The present invention further provides a drying machine comprising a drum; a discharging duct which communicates with the drum, and which discharges inner air of the drum outward; a supplying duct which communicates with the drum, and which supplies external air into the drum to make a flow direction of the external air pass across that of the inner air discharged outward through the discharging duct; and a heat exchanger connected to the discharging duct and the supplying duct, in which a first air flow path which passes therethrough the inner air discharged outward through the discharging duct and a second air flow path which passes therethrough the external air supplied into the drum through the supplying duct cross each other.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
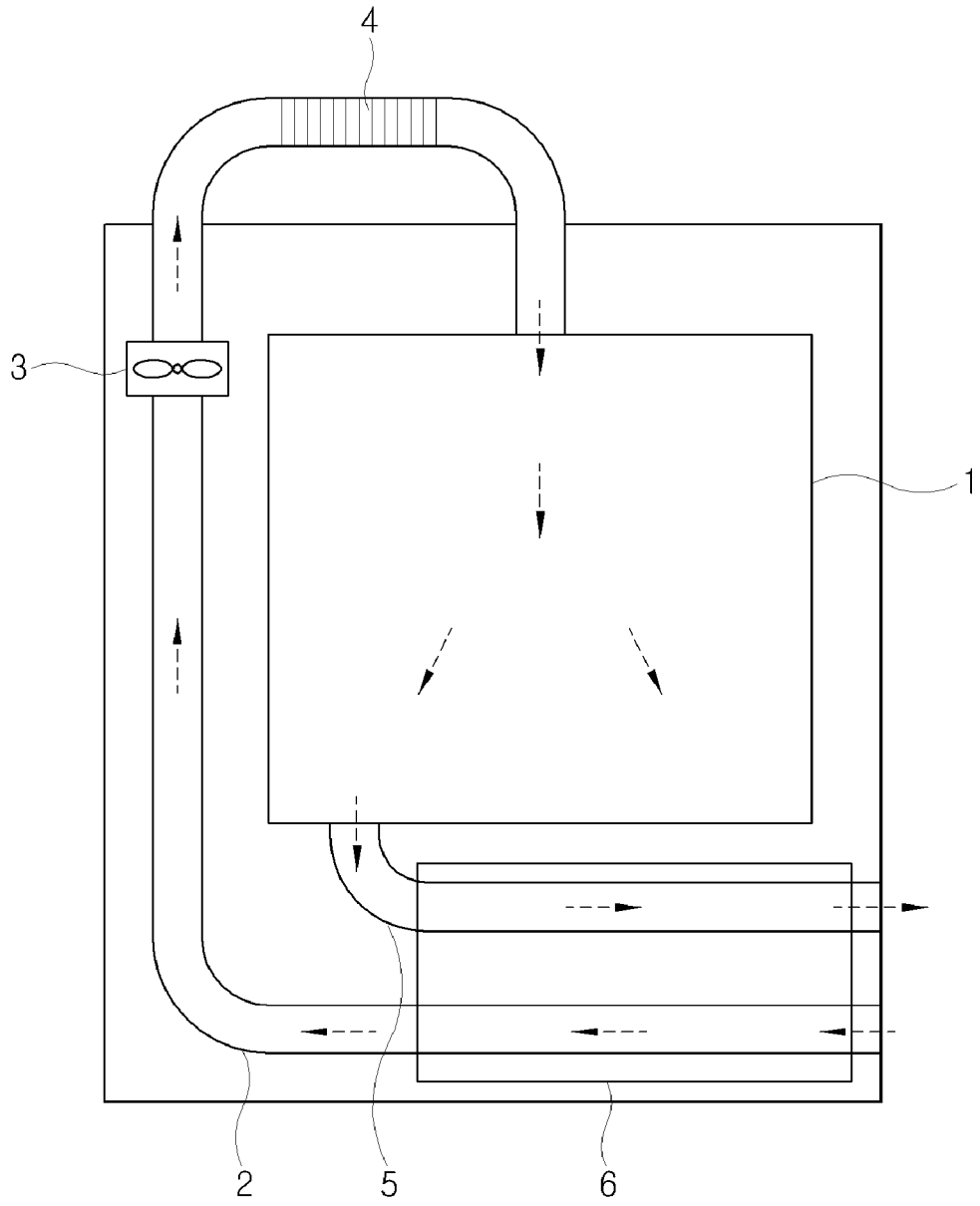
FIG. 1 (PRIOR ART)
FIG. 1 schematically illustrates a configuration of a conventional washing machine.

DETAILED DESCRIPTION OF THE ILLUSTRATIVE, NON-LIMITING EMBODIMENTS OF THE INVENTION

Reference will now be made in detail to the illustrative, non-limiting embodiments of the present invention, examples of which are illustrated in the accompanying drawings, wherein like reference numerals refer to the like elements throughout.

Figure 2A:
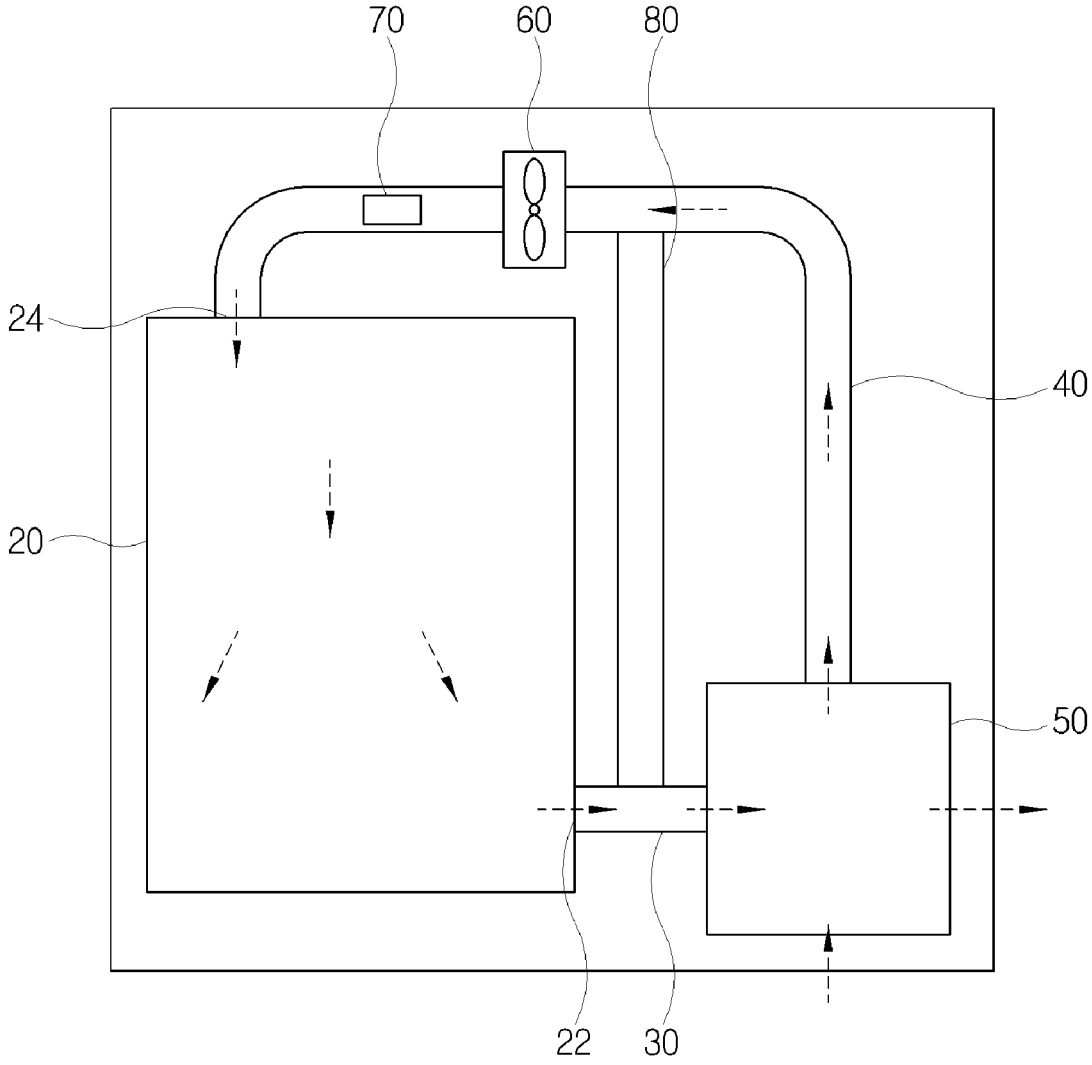
FIG. 2A schematically illustrates a first exemplary embodiment of a configuration of a washing machine according to the present invention.

As shown in FIG. 2A, a washing machine consistent with a first embodiment of the present invention comprises a drum 20; a discharging duct 30 provided to be communicated with the drum 20 and for discharging inner air in the drum 20 outward; a supplying duct 40 provided to be communicated with the drum 20 and supplying external air into the drum 20 to make a flow direction of the external air across that of the inner air; and a heat exchanger 50 connected to the discharging duct 30 and the supplying duct 40, and exchanging heat between the inner air discharged outward through the discharging duct 30 and the external air supplied thereinto through the supplying duct 40.

Figure 2B:
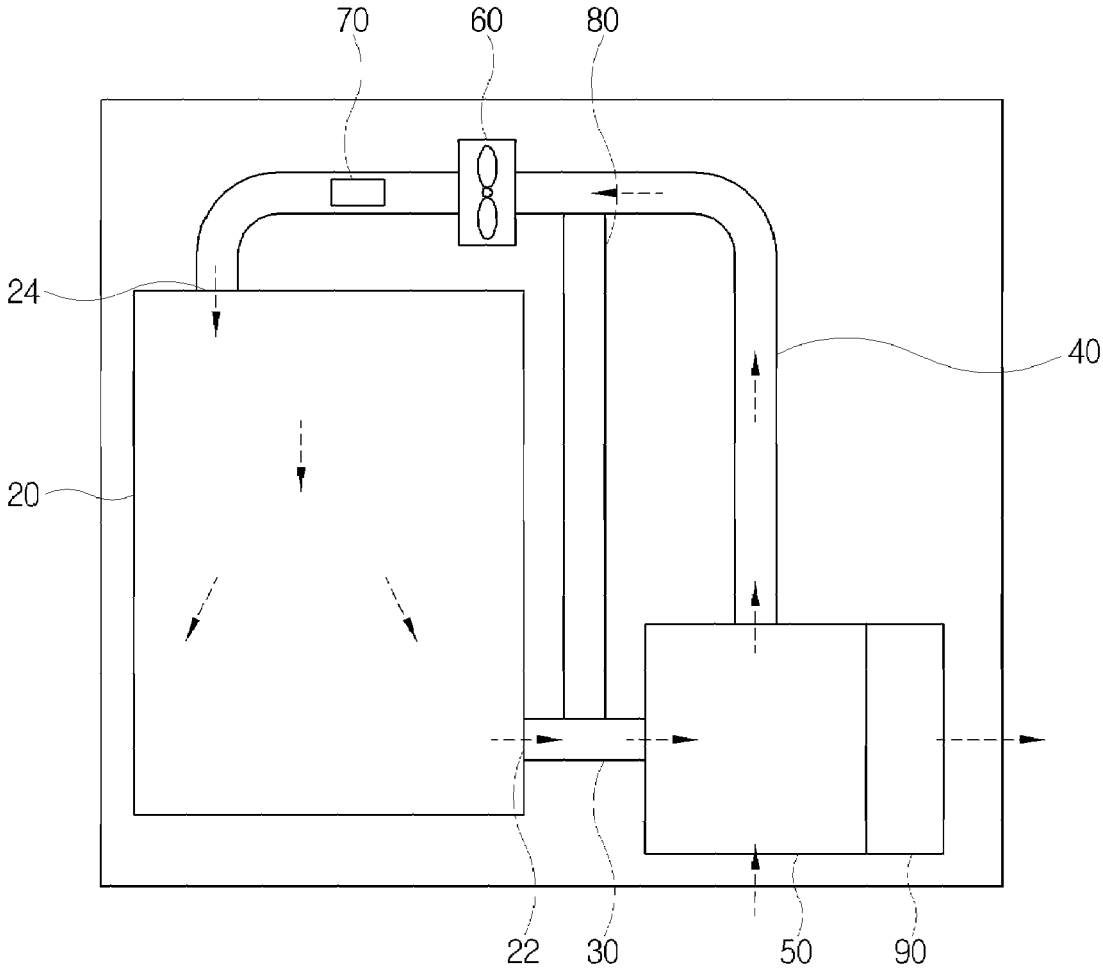
FIG. 2B schematically illustrates a second exemplary embodiment of a configuration of a washing machine according to the present invention.

As shown in FIG. 2B, a washing machine consistent with a second embodiment of the present invention is the same as that of FIG. 2A, but also includes a humidity modulating part 90 provided at a rear of the heat exchanger 50 for reducing humidity of the internal air discharged outward through the discharging duct 30 and the heat exchanger 50.

With reference to FIGS. 2A-B, washing machines according to the first and second exemplary embodiments will now be described. Except where noted, the following description applies to the washing machines illustrated in both FIG. 2A and in FIG. 2B.

In the drum 20 are respectively formed an air outlet 22 connected to the discharging duct 30 and an air inlet 24 connected to the supplying duct 40.

A first end of the discharging duct 30 is communicated with the air outlet 22 of the drum 20 and a second end thereof is communicated with the heat exchanger 50. A first end of the supplying duct 40 is communicated with the air inlet 24 of the drum 20 and a second end thereof is communicated with the heat exchanger 50.

In the supplying duct 40, a fan 60 and a heater 70 are provided to dry clothes after a dewatering operation. The fan 60 supplies the external air into the supplying duct 40 and introduces the external air to the heater 70. Then, the heater 70 heats the air introduced by the fan 60.

Accordingly, after the air from the fan 60 is heated by the heater 70 while passing through the supplying duct 40, the air is introduced into the drum 20 through the, air inlet 24 of the drum 20 so as to heat and dry the clothes. The inner air generated from the drying operation is introduced into the discharging duct 30 through the air outlet 22 of the drum 20. Then, the heat of the inner air introduced into the discharging duct 30 is exchanged with that of the external air supplied into the heat exchanger 50 from outside thereof while passing through the heat exchanger 50 so that temperature of the inner air becomes low and then, the inner air is discharged outward. Also, the heat of the external air is exchanged with that of the inner air while passing through the heat exchanger 50 so that temperature of the external air becomes high and the external air is introduced into the drum 20 through the supplying duct 40.

Figure 3A:
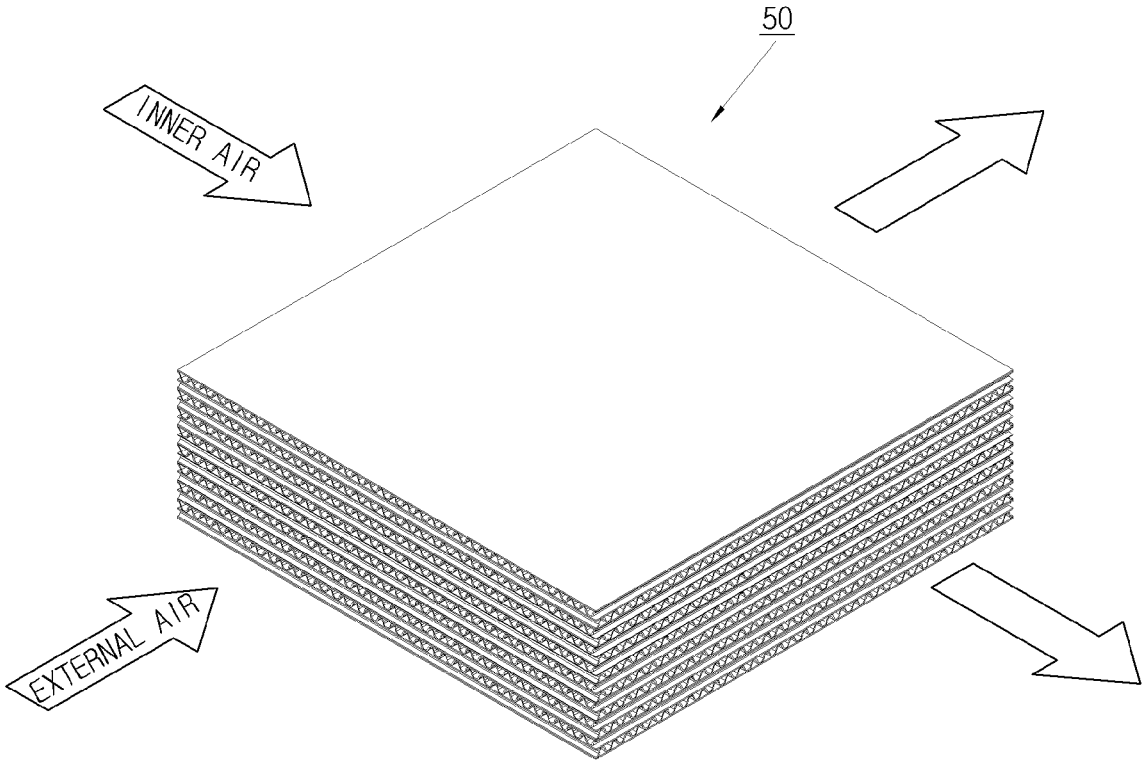
FIG. 3A illustrates a state of flow directions of inner air and external air passing through a heat exchanger provided in a washing machine according to the first exemplary embodiment of the present invention illustrated in FIG. 2A.
Figure 3B:
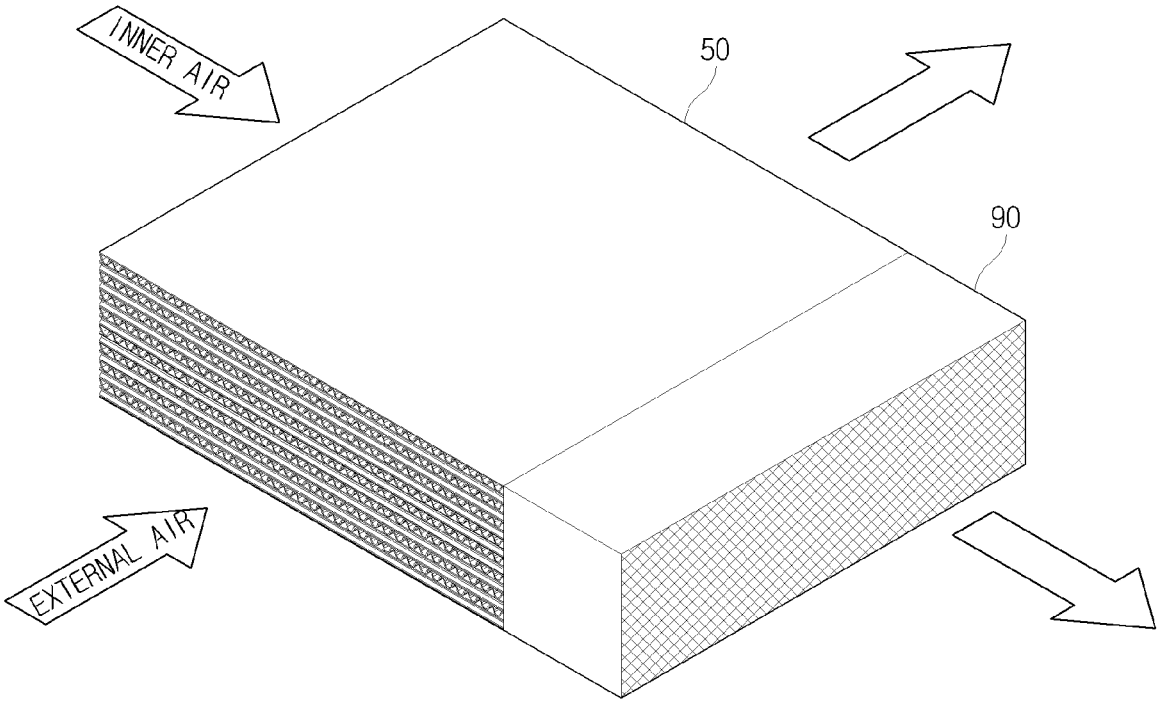
FIG. 3B illustrates a state of flow directions of inner air and external air passing through a heat exchanger provided in a washing machine according to the second exemplary embodiment of the present invention illustrated in FIG. 2B.
Figure 4:
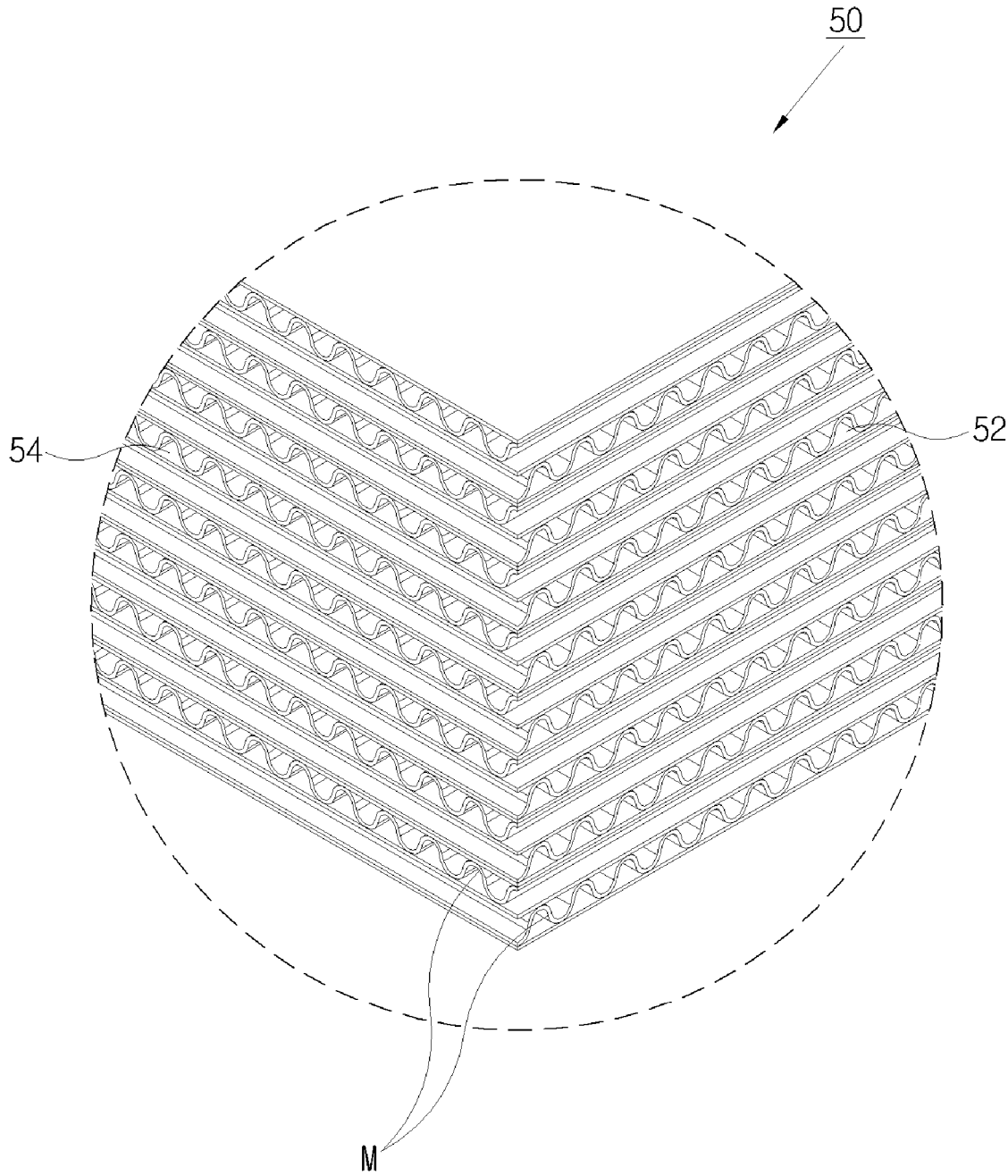
FIG. 4 is a perspective view illustrating an enlarged inner configuration of a heat exchanger provided in a washing machine according to the present invention.

In the heat exchanger 50, an air path which passes therethrough the inner air and an air path which passes therethrough the external air cross each other to enhance efficiency of heat exchange. For example, a first air flow path 52 passing therethrough the inner air discharged outward through the discharging duct 30 and a second air flow path 54 passing therethrough the external air supplied into the drum 20 through the supplying duct 40 cross each other as shown in FIGS. 3A-B and 4.

The inner air of high temperature discharged outward through the discharging duct 30 loses the heat so that the temperature of the inner air becomes low. Also, the external air of low temperature supplied thereinto through the supplying duct 40 is heated with the heat from the inner air passing through the discharging duct 30 so that the temperature of the external air becomes high. Accordingly, drying efficiency is enhanced, and also installation cost is decreased because the air, which is discharged out of a building at the conventional washing machine, may be discharged into a washing room.

The first air flow path 52 and the second air flow path 54 of the heat exchanger 50 are respectively provided plurally, and respective layers of the first air flow paths 52 and layers of the second air flow paths 54 are alternately stacked up on each other. The members M which form the first air flow paths 52 and the second air flow paths 54 are shaped like waves (e.g., corrugated) and the air flow path forming members M may comprise aluminum with good heat conductivity.

The shape and material of members M forming the first air flow paths 52 and the second air flow paths 54 may be variously changed as necessary so far as the flow direction of the first flow air paths 52 and the second air flow paths 54 may cross each other.

Meanwhile, when the washing machine comprises the heat exchanger 50 with this configuration, inner pressure may increase due to pressure-loss which is generated when the inner air of the drum 20 passes through the heat exchanger 50. To avoid increasing of the inner pressure, the washing machine according to the present invention is preferred, but not necessary, to comprise an inner circulation duct 80 communicating with the discharging duct 30 and the supplying duct 40 so as to make the inner air passing through the heat exchanger 50 smoothly flow therein. The amount of the inner air introduced to the inner circulation duct 80 is appropriately modulated by the size of a diameter and an interference projection, etc. and a condensing duct may be employed for the inner circulation duct 80.

Figure 5:
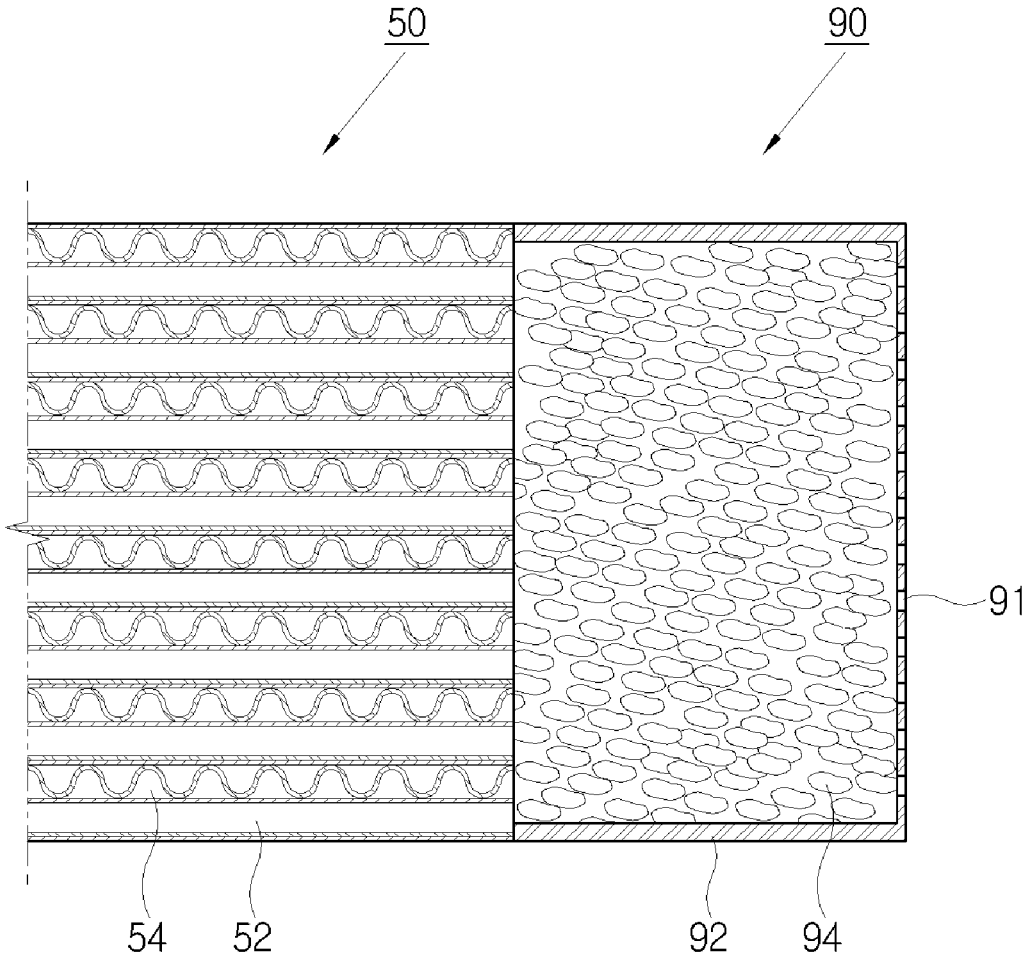
FIG. 5 is a sectional view illustrating a configuration of a humidity modulating part of a washing machine according to the second exemplary embodiment of the present invention.

In the second exemplary embodiment illustrated in FIG. 2B, heat exchanger 50 also includes a humidity modulating part 90. As shown in FIGS. 3B and 5, the humidity modulating part 90 communicates with the first air flow paths 52 of the heat exchanger 50 and is employed for decreasing the humidity of the inner air discharged outward through the first air flow paths 52 of the heat exchanger 50.

The humidity modulating part 90 may eliminate or reduce the humidity of the inner air discharged outward through the heat exchanger 50. Accordingly, the washing machine may discharge air which has similar humidity with air in a building so that the drum may discharge air inside the building, not outside the building.

A structure of the humidity modulating part 90 may be variously changed as necessary so far as the humidity modulating part 90 decreases the humidity of the inner air discharged outward through the first air flow paths 52 of the heat exchanger 50. For example, the humidity modulating part 90 may comprise a casing 92 which communicates with the heat exchanger 50 and has an opening at a side thereof, and a filler 94 filled in the casing 92 so as to pass therethrough the air as shown in FIG. 5. Accordingly, the humidity of the inner air discharged outward is eliminated while the inner air passes through the space among the fillers 94.

The casing 92 comprises a plurality of air vents 91 on a side thereof so as to discharge the inner air which passed the space among the filler 94. A position of the air vents 91 may be variously changed as necessary.

The humidity modulating part 90 may comprise porous material.

Figure 6:
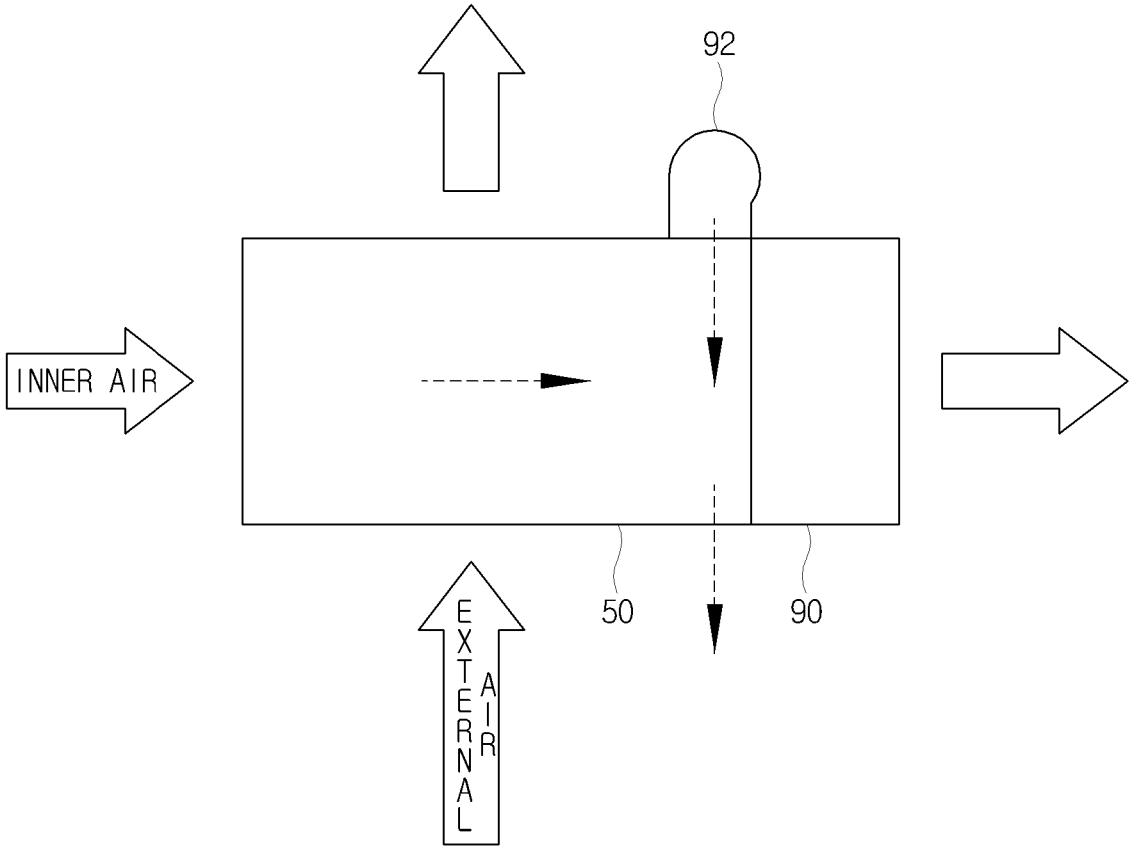
FIG. 6 schematically illustrates a position of a temperature modulating fan in a washing machine according to a further asepct of the present invention.

As shown in FIG. 6, according to a further aspect of the invention, the washing machine may further comprise a temperature modulating fan 92 at a rear of the heat exchanger 50 that makes outer air flow toward the heat exchanger 50 to further decrease the temperature of the inner air discharged outward through the heat exchanger 50. While the heat exchanger 50 shown in FIG. 6 is illustrated as including humidity modulating part 90, one of ordinary skill would appreciate that temperature modulating fan 92 can be employed without including humidity modulating part 90.

A structure of the temperature modulating fan 92 per se is well-known in the art, and accordingly the detailed description thereof will be avoided.

Although exemplary embodiments of the present invention have been shown and described, it would be appreciated by those skilled in the art that changes may be made in these embodiments without departing from the principles and spirit of the invention, the scope of which is defined in the claims and their equivalents.

While the present invention describes a washing machine as one embodiment, it is possible that similar devices such as a drying machine to dry clothes are also usefully applied by those skilled in the art. In such a case, a drum of a washing machine performs the same function as a drum of a drying machine to accommodate clothing. Also, the other elements are identically applicable.

The configuration of the drying machine is similar to that of the washing machine shown in FIGS. 2*a*-2*b*. Thus, the drawing of the drying machine is not shown in this specification.

What is claimed is:

1. A washing machine comprising:

a drum;

a discharging duct which communicates with the drum, and which discharges inner air of the drum outward;

a supplying duct which communicates with the drum, and which supplies external air into the drum to make a flow of the external air pass across that of the inner air discharged outward through the discharging duct; and a heat exchanger connected to the discharging duct and the supplying duct, in which a first air flow path, which passes therethrough the inner air discharged outward through the discharging duct, and a second air flow path, which passes therethrough the external air supplied into the drum through the supplying duct, cross each other.

2. The washing machine according to claim 1, wherein the first air flow path comprises a plurality of layers and the second air flow path comprises a plurality of layers, wherein the layers of the first air flow path and the layers of the second air flow path are alternately stacked.

3. The washing machine according to claim 2, wherein members which form the first air flow paths and the second air flow paths are respectively shaped like waves.

4. The washing machine according to claim 1, wherein members which form the first air path and the second path comprise aluminum.

5. The washing machine according to claim 2, wherein members which form the first air flow paths and the second air flow paths comprise aluminum.

6. The washing machine according to claim 3, wherein the members which form the first air flow paths and the second air flow paths comprise aluminum.

7. The washing machine according to claim 1, further comprising an inner circulation duct communicating with the discharging duct and the supplying duct and to facilitate the flow of the inner air.

8. The washing machine according to claim 1, further comprising a humidity modulating part which communicates with the first air flow path of the heat exchanger and which decreases humidity of the inner air which passes through the first air flow path.

9. The washing machine according to claim 8, wherein the humidity modulating part comprises porous material.

10. The washing machine according to claim 8, wherein the humidity modulating part comprises a casing which communicates with the heat exchanger and has an opening at a side thereof, and a filler filled inside the casing so as to pass therethrough the inner air.

11. The washing machine according to claim 1, further comprising a temperature modulating fan flowing outer air from a rear of the heat exchanger, and which decreases the temperature of the inner air discharged outward through the heat exchanger.

12. The washing machine according to claim 8, wherein the first air flow path comprises a plurality of layers and the second air flow path comprises a plurality of layers, wherein the layers of the first air flow path and the layers of the second air flow path are alternately stacked.

13. The washing machine according to claim 12, wherein members which form the first air flow paths and the second air flow paths are respectively shaped like waves.

14. The washing machine according to claim 12, wherein members which form the first air path and the second path comprise aluminum.

15. The washing machine according to claim 13, wherein members which form the first air flow paths and the second air flow paths comprise aluminum.

16. The washing machine according to claim 8, further comprising an inner circulation duct which communicates with the discharging duct and the supplying duct to facilitate the flow of the inner air.

17. A drying machine comprising:

a drum;

a discharging duct which communicates with the drum, and which discharges inner air of the drum outward;

a supplying duct which communicates with the drum, and which supplies external air into the drum to make a flow of the external air pass across that of the inner air discharged outward through the discharging duct; and a heat exchanger connected to the discharging duct and the supplying duct, in which a first air flow path, which passes therethrough the inner air discharged outward through the discharging duct, and a second air flow path, which passes therethrough the external air supplied into the drum through the supplying duct, cross each other.

18. The drying machine according to claim 17, wherein the first air flow path comprises a plurality of layers and the second air flow path comprises a plurality of layers, wherein the layers of the first air flow path and the layers of the second air flow path are alternately stacked.

19. The drying machine according to claim 18, wherein members which form the first air flow paths and the second air flow paths are respectively shaped like waves.

* * * * *